US008357887B2

(12) United States Patent
Rich

(10) Patent No.: US 8,357,887 B2
(45) Date of Patent: Jan. 22, 2013

(54) MICROWAVABLE APPARATUS CAPABLE OF KEEPING FOOD MOIST

(75) Inventor: Hilary Rich, Los Angeles, CA (US)

(73) Assignee: Rich Ventures LLC, Los Angeles, CA (US)

( * ) Notice: Subject to any disclaimer, the term of this patent is extended or adjusted under 35 U.S.C. 154(b) by 379 days.

(21) Appl. No.: 12/662,059

(22) Filed: Mar. 30, 2010

(65) Prior Publication Data

US 2011/0240634 A1 Oct. 6, 2011

(51) Int. Cl.
*H05B 6/80* (2006.01)

(52) U.S. Cl. ..... 219/732

(58) Field of Classification Search ..... 219/732
See application file for complete search history.

(56) References Cited

U.S. PATENT DOCUMENTS

| | | | | |
|---|---|---|---|---|
| 4,922,071 | A * | 5/1990 | Samford | 219/728 |
| 6,608,292 | B1 * | 8/2003 | Barnes | 219/730 |
| 2009/0217328 | A1 * | 8/2009 | Colmagro et al. | 725/91 |

* cited by examiner

*Primary Examiner* — A. Sefer
(74) *Attorney, Agent, or Firm* — Bacon & Thomas, PLLC

(57) ABSTRACT

A microwavable apparatus capable of keeping food moist is composed of a bottom pan and at least one support frame stacked upon the bottom pan. Each of the at least one support frame includes a vapor release pan and a support member for supporting the vapor release pan up to a predetermined height. When the food is heated in a microwavable oven, the water in the accommodable cavity can pass through the microwave heating to become vapors and then the vapors can be transferred to vents and an internal space of the vapor release pan and finally ejected through the vents. Accordingly, the food put under the vapor release pan can keep moist rather than over-dried due to excessive evaporation of moisture.

7 Claims, 2 Drawing Sheets

MICROWAVABLE APPARATUS CAPABLE OF KEEPING FOOD MOIST

BACKGROUND OF THE INVENTION

1. Field of the Invention

The present invention relates generally to a microwavable apparatus, and more particularly, to a microwavable apparatus capable of keeping food moist.

2. Description of the Related Art

A microwave oven is a popular electric appliance for an individual or a family to heat the food. Although it is very handy and efficient, it is detective that the moisture in the food is subject to excessive evaporation in the process of the microwave heating. For this reason, the food heated by the microwave oven is subject to loss of the original hue, taste, and even flavor.

To keep the moisture of the heated food, the common way is to put a glass of water in the microwave oven beforehand or to install a bottom pan containing water for providing the moisture required for the food under the microwave heating to avoid excessive evaporation of the moisture in the food. However, the topmost part of the food may still inevitably become over-dried and hard. In other words, the foresaid way of keeping the moisture of the food is still defective to need further improvement.

SUMMARY OF THE INVENTION

The primary objective of the present invention is to provide a microwavable apparatus, which can keep the moisture of the food heated by the microwave oven.

The foregoing objective of the present invention is attained by the microwavable apparatus composed of at least one support frame having a vapor release pan and a support member. The vapor release pan is provided with an internal space and a bottom side having a plurality of vents in communication with the internal space. The support member is connected with the vapor release pan for supporting the vapor release pan up to a predetermined height, having at least one accommodable cavity in communication with the internal space. In this way, the water in the accommodable cavity can pass through the microwave heating to become vapors and then the vapors can be transferred to the internal space and finally ejected through the vents. Accordingly, the food put under the vapor release pan can keep moist, especially the topmost part thereof.

In the microwavable apparatus, the support member further includes at least two bars, at east one of which contains the at least one accommodable cavity and a lid pivoted thereto for covering an opening of the accommodable cavity. In this way, the bars can support the vapor release pan up to a predetermined height, the accommodable cavity can reserve the water which can be heated to become the vapors, and the lid can prevent the vapors from leakage out of the opening.

In the microwavable apparatus, the vapor release pan further includes a pan piece and a cover piece covered onto the pan piece and defining the internal space therein. In this way, the vapor release pan can be internally cleaned more conveniently and the pan piece and the support member can be connected in one piece to decrease the inconvenience of the assembly.

In the microwavable apparatus, there are at least two support frames, which are interconnected and stacked upon each other by the support members. In this way, a proper number of the support frames can be stacked according to the internal height of the microwave oven to increase the capacity of the food to be put in the microwave oven. Besides, the microwavable apparatus can further include a bottom pan connected with the support member of one of the support frames. In this way, the microwavable apparatus can have the bottom pan having the largest contact surface be its bottommost side to stand on a tray in the microwave oven to enhance its firmness. Besides, the food intended to put under the pan piece can be put on the bottom pan rather than the tray in such a way that all of the food together with the microwavable apparatus can be together put into or taken out of the microwave oven, thus enhancing the convenience in use.

In the microwavable apparatus, there are two support frames preferably, which define a first support frame and a second support frame respectively. Each of the support frames includes three bars each having an upper fastener and a lower fastener. The lower fasteners of the second support frame are fixed to the upper fasteners of the first support frame respectively. Each of the bars of the first support frame further includes a lower fastener fixed to the bottom pan.

DETAILED DESCRIPTION OF PREFERRED EMBODIMENTS

Figure 1:
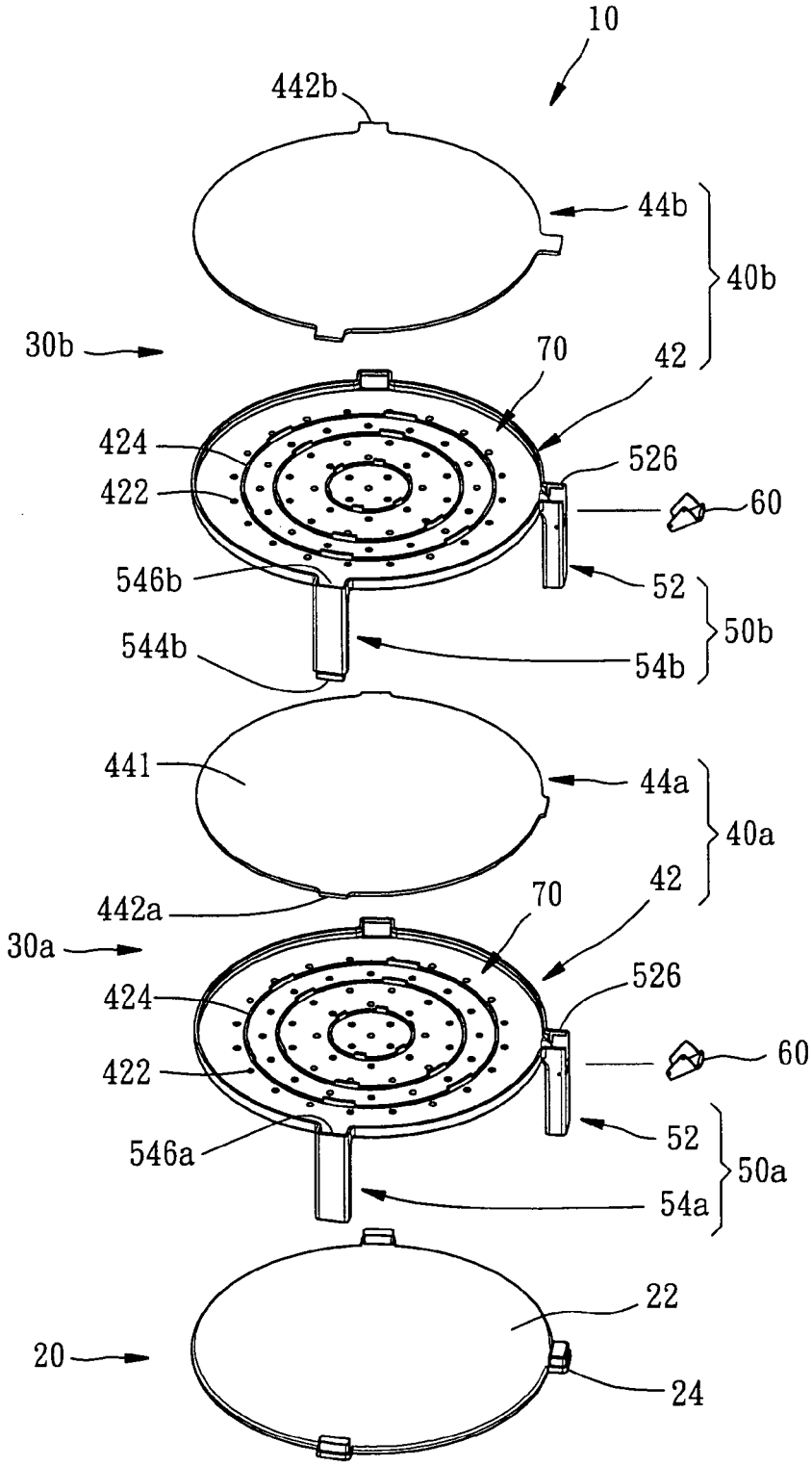
FIG. 1 is an exploded view of a preferred embodiment of the present invention.
Figure 2:
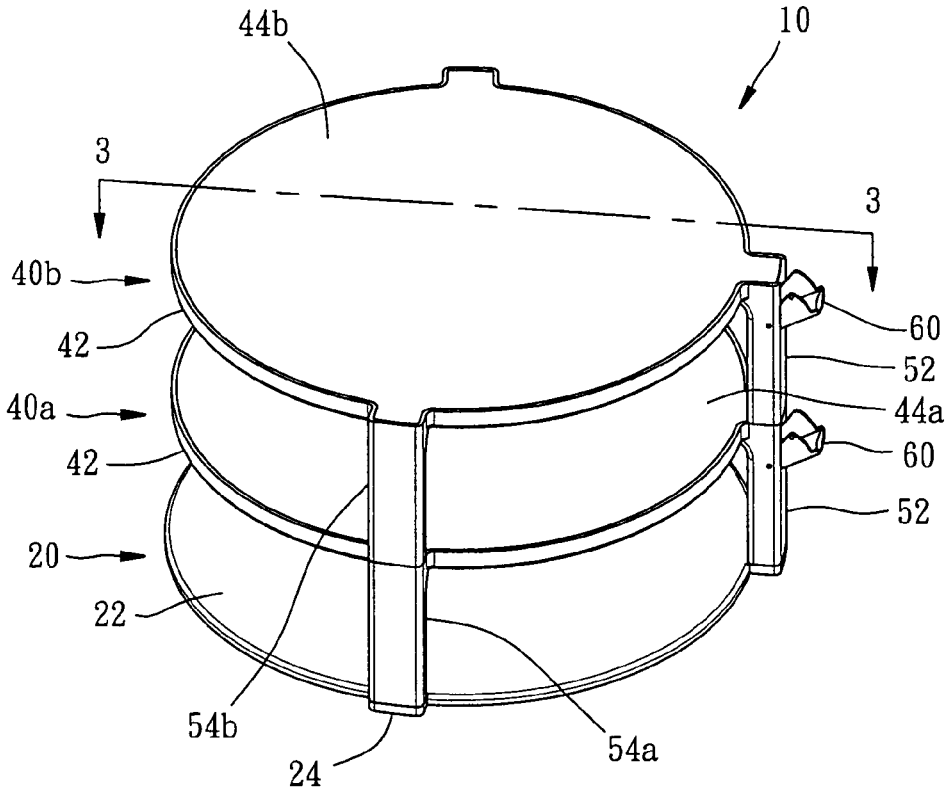
FIG. 2 is a perspective view of the preferred embodiment of the present invention.
Figure 3:
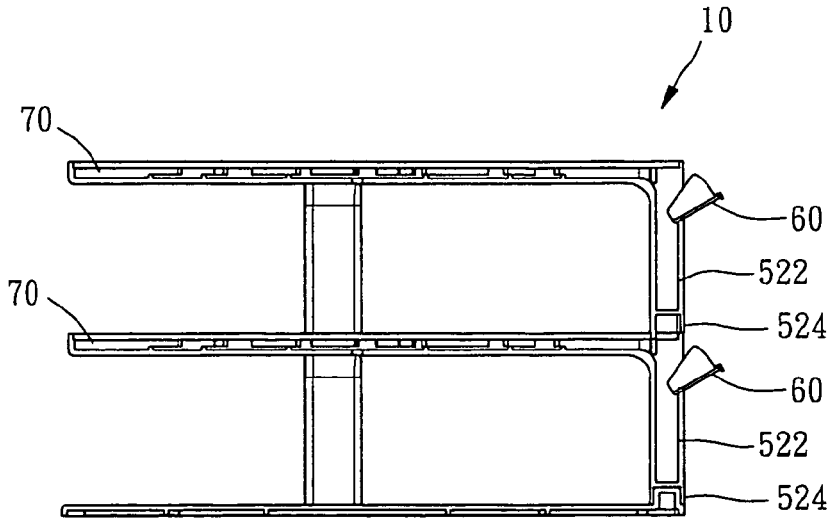
FIG. 3 is a sectional view taken along a line 3-3 indicated in FIG. 2.

Referring to FIGS. 1-3, a microwavable apparatus 10 capable of keeping food moist in accordance with a preferred embodiment of the present invention is composed of a bottom pan 20, a first support frame 30*a*, and a second support frame 30*b*.

The bottom pan 20 is made of heat-resistant plastic in one piece and includes a round pan body 22 and three fastening portions 24 protruding upward and outward from respective predetermined positions of a peripheral edge of the pan body 22. An imaginary line connected between a center of each of the fastening portions 24 and a center of the pan body 22 defines an included angle of 90 or 180 degrees with a line connected the center of either of the other fastening portions 24 and the center of the pan body 22.

The first support frame 30*a* is made of heat-resistant plastic and includes a vapor release pan 40*a* and a support member 50*a*. The vapor release pan 40*a* includes a pan piece 42 and a cover piece 44*a*. The pan piece 42 has a bottom side having the same shape and size with those of the pan body 22, having a plurality of vents 422 and three support portions 424. The vents 422 run through the bottom side of the pan piece 42. The three support portions 424 protrude upward and are arranged in three concentric circles respectively. The cover piece 44*a* has a round body portion 441 and three protrusions 442*a*. The body portion 441 is smaller than the pan piece 42. The protrusions 442*a* each extend outward from a peripheral edge of the body portion 441 and are arranged to correspond to that of the fastening portions 24. The support member 50*a* includes an accommodable bar 52 and two support bars 54*a*. The accommodable bar 52 has a rectangular cross-section and an accommodable cavity 522 internally. A lid 60 is pivoted to a lateral opening of the accommodable cavity 522 for covering the lateral opening of the accommodable cavity 522. The accommodable bar 52 has a lower fastener 524 recessed inward and an upper fastening end 526 having an upper opening. Each of the support bars 54*a* though has a similar appearance to that of the accommodable bar 52, but it does not have that accommodable cavity 522, having a lower fastener (not shown) recessed inward and an upper fastener 546*a* recessed inward and having an opening. A topmost part of each of the bars 52 and 54*a* is aligned with that of a peripheral edge of the pan piece 42 and connected with the peripheral edge of the pan piece 42 in one piece. Moreover, where the bars 52 and 54*a* are arranged on the pan piece 42 corresponds to where the protrusions 442*a* of the cover piece 44*a* are arranged on the peripheral edge of the body portion 441. In light of this, the cover piece 44*a* is covered on the pan piece 42 by aligning the protrusions 442*a* with the bars 52 and 54*a*. The support portions 424 can support the cover piece 44*a* to allow the cover piece 44*a* and the pan piece 42 to jointly define an internal space 70 in communication with the accommodable cavity 522. The protrusions 442*a* of the cover piece 44*a* can partially cover the upper opening of the upper fastening end 526 and the opening of the upper fastener 546*a*.

The second support frame 30*b* is structurally similar to the first support frame 30*a* and likewise includes a vapor release pan 40*b* and a support member 50*b*. The support member 50*b* is different from the first support member 50*a* by that the support bar 54*b* of the support member 50*b* has a lower fastener 544*b* protruding outward. The vapor release pan 40*b* is different from the vapor release pan 40*a* of the first support frame 30*a* by that the cover piece 44*b* of the vapor release pan 40*b* has the larger protrusions 442*b* than those of the vapor release pan 40*a*, such that the protrusions 442*b* can fully cover the lateral opening of the accommodable cavity 522 and the opening of the upper fastener 546*b*.

When it is intended to assemble the microwavable apparatus 10, the lower fastener 544*b* and the lower fastener 524 of the first support frame 30*a* are fitted to the protrusions 24 and then the lower fastener 544*b* of the second support frame 30*b* is inserted into the upper fastener 546*a* of the first support frame 30*a*; meanwhile, the lower fastener 524 of the second frame 30*b* lies against the upper fastening end 526 of the first support frame 30*a*. In this way, the bottom pan 20, the first support frame 30*a*, and the second support frame 30*b* are fixedly stacked upon one another to become the microwavable apparatus 10.

When it is intended to use the microwavable apparatus 10, pour the water into the accommodable cavities 522, seal the lateral openings of the accommodable cavities 522 respectively, and then put the food on the bottom pan 522 and the cover piece 44*a*. While the food is heated in the microwave oven along with the microwavable apparatus 10, the water in the accommodable cavities 522 is evaporated into vapors and the vapors are transferred to the internal space 70 and ejected through the vents 422, such that the food (especially the topmost part) under the pan piece 42 can keep moist.

It is to be noted that the pan body 22 and the vapor release pans 40*a* and 40*b* are not limited to circle but either shape as long as they can receive the food and allow to be put into the microwave oven. Besides, the number and arrangement place of the fastening portions 24 and the bars 52, 54*a*, and 54*b* are not limited to what mentioned above but either as long as they can make the microwavable apparatus 10 enough firm and do not interfere when the food is put therein. In addition, the number of the support frames 30*a* and 30*b* is not limited to two but only one or more than two as per the requirement and the sufficient space.

Although the present invention has been described with respect to a specific preferred embodiment thereof, it is in no way limited to the specifics of the illustrated structures but changes and modifications may be made within the scope of the appended claims.

What is claimed is:

1. A microwavable apparatus capable of keeping food moist, comprising at least one support frame, wherein the at least one support frame having;

a vapor release pan having an internal space, a bottom side, and a plurality of vents located at the bottom side and in communication with the internal space;

a support member connected with the vapor release pan for supporting the vapor release pan up to a predetermined height, the support member having at least one accommodable cavity in communication with the internal space of the vapor release pan, and further comprising a bottom pan, wherein the bottom pan is connected with the support member, and wherein the at least one support frame is two in number to define a first support member and a second support member, the support member of each of the two support frames having three bars, each of the bars of the first support frame having an upper fastener and a lower fastener, each of the bars of the second support frame having a lower fastener, the lower fasteners of the second support member being fixed to the upper fasteners of the first support frame respectively, the lower fasteners of the first support frame being connected with the bottom pan.

2. The microwavable apparatus as defined in claim 1, wherein the support member comprises at least two bars, at least one of the bars having the at least one accommodable cavity.

3. The microwavable apparatus as defined in claim 2, wherein the at least one bar having the at least one accommodable cavity comprises a lid pivoted thereto for covering an opening of the accommodable cavity.

4. The microwavable apparatus as defined in claim 1 or 2 or 3, wherein the support member is connected with the vapor release pan in one piece.

5. The microwavable apparatus as defined in claim 1 or 2 or 3, wherein the vapor release pan comprises a pan piece and a cover piece covered onto the pan piece to define the internal space.

6. The microwavable apparatus as defined in claim 5, wherein the support member is connected with the pan piece in one piece.

7. The microwavable apparatus as defined in claim 1, wherein the at least one support frame further comprises an additional support frame, and wherein the at least one support frame and the additional support frame are interconnected by the respective support members.

* * * * *